US008273002B2

(12) United States Patent
Tipu

(10) Patent No.: US 8,273,002 B2
(45) Date of Patent: Sep. 25, 2012

(54) PAINT ROLLER

(76) Inventor: Vichente Tipu, North York (CA)

( * ) Notice: Subject to any disclaimer, the term of this patent is extended or adjusted under 35 U.S.C. 154(b) by 1216 days.

(21) Appl. No.: 12/058,263

(22) Filed: Mar. 28, 2008

(65) Prior Publication Data

US 2009/0247379 A1 Oct. 1, 2009

(51) Int. Cl.
*B05C 17/02* (2006.01)

(52) U.S. Cl. ..... 492/17; 492/13; 492/19

(58) Field of Classification Search ..... 492/13, 492/16, 17, 19

See application file for complete search history.

(56) References Cited

U.S. PATENT DOCUMENTS

| | | | | |
|---|---|---|---|---|
| 5,755,004 | A * | 5/1998 | Miller | 15/230.11 |
| 5,903,952 | A * | 5/1999 | Camp et al. | 15/230.11 |
| 2007/0130714 | A1 * | 6/2007 | Williams | 15/230.11 |

* cited by examiner

*Primary Examiner* — David Bryant
*Assistant Examiner* — Christopher Besler

(57) ABSTRACT

A paint roller assembly providing a friction hinge for a swiveling connection between the handle and the paint applicator and a clip for locking the tubular paint applicator against unwanted axial displacement during the use.

5 Claims, 4 Drawing Sheets

PAINT ROLLER

CROSS-REFERENCE TO RELATED APPLICATIONS

| US Patents documents | | | |
|---|---|---|---|
| 2,520,863 | August, 1950 | Thomas | 15/230.11 |
| 2,749,599 | June, 1956 | Kreger | 429/19 |
| 2,982,010 | May, 1961 | Johns | 429/19 |
| 3,273,192 | September, 1966 | Mazzella | 15/230.11 |
| 4,196,491 | April, 1980 | Baril | 15/230.11 |
| 4,316,301 | February, 1982 | Smith | 15/230.11 |
| 4,467,509 | August.,1984 | Dezen | 429/19 |
| 4,897,893 | February, 1990 | Barker | 15/230.11 |
| 4,937,909 | July, 1990 | Giorgiou | 15/230.11 |
| 5,207,755 | May, 1993 | Ampian | 15/230.11 |
| 5,345,648 | September, 1994 | Graves | 15/230.11 |
| 5,755,004 | May, 1998 | Miller | 15/230.11 |
| 5,806,129 | September, 1998 | Nelson | 15/230.11 |
| 5,903,952 | May, 1999 | Camp | 15/230.11 |
| 6,128,802 | October, 2000 | Lye | 15/230.11 |
| 6,702,727 | March, 2004 | Karsten | 429/19 |
| 7,213,294 | May, 2007 | Karroll | 15/230.11 |

BACKGROUND OF INVENTION

The present invention relates to a paint roller with handle apparatus using a tubular paint applicator and providing both the means for granting a swiveling movement of the paint applicator related to the handle, and the means for locking the tubular paint applicator against axial displacement.

Adjustable paint rollers are well known, such as in the U.S. Pat. Nos. 3,273,192; 4,196,491; 5,207,755; 5,903,952; 6,702,727; 7,213,294.

One of the major inconveniences of all of those adjustable paint rollers is that they require intervention of the operator to set the desirable angle, which causes work interruption.

Another inconvenience is that, because the adjusting may only be done in a few predetermined rigid positions, the angle of adjusting is fixed until a new adjusting will be done.

Another inconvenience is that, because the angle of adjusting is rigid, the pressure between the paint applicator and the surface to be painted is not even.

Solutions have been developed to offer rotatable support of a tubular paint applicator such in the U.S. Pat. Nos. 2,520,863; 2,749,599; 2,982,010; 4,897,893; 4,937,909; 5,345,648.

The attempt of those solutions to retain the paint applicator against axial displacement is based on frictional engagement of the plastic or wire cage with the inner of the paint applicator sleeve. Because the friction is not enough, an axial displacement of the paint applicator occurs during operation causing work interruption for repositioning.

Therefore, other solutions provide an additional axial retainer, such in the U.S. Pat. Nos. 4,316,301; 4,467,509; 5,755,004; 5,806,129; 6,128,802.

However, the inconvenience of these solutions may reside in the difficulty to insert and remove the paint applicator; at some the retainer is detachable and can be lost, and some require additional tools.

SUMMARY OF THE INVENTION

In view of the above mentioned disadvantages of the paint rollers in the prior art, the present invention provides an improved paint roller.

One aspect of the present invention relates to a friction hinge which allows the paint applicator to swivel relative to the handle in an optimal position, in a continuous self adjustment for a permanent contact with the surface to be painted, and also to swivel in an extreme position for painting areas where a regular paint roller can not be used.

Another aspect of the present invention relates to a method of securing the paint applicator against axial displacement, using a flexible wire clip that locks the tubular paint applicator against unwanted axial displacement.

The paint roller uses a standard tubular paint applicator and includes a bent rod portion and a handle portion connected together by a friction hinge.

The bent rod portion has at one end an applicator shaft and at the other end a hinge shaft.

The applicator shaft and the hinge shaft are situated in two perpendicular planes. The handle portion has a grip handle that supports hinge housing.

The friction hinge includes the hinge housing and the hinge shaft and makes a swiveling connection between the handle and the paint applicator.

The hinge housing encloses coaxially the hinge shaft, and a contact pressure is provided between them, such as a constant torque is required for rotation.

The applicator shaft of the bent rod rotatably sustains two wheels supporting the tubular paint applicator.

The right wheel that supports the right side of the paint applicator has a flange that engages the right end of the paint applicator sleeve to prevent the paint applicator displacement towards right.

In the left wheel that supports the left side of the paint applicator, a wire clip is inserted having two vertical legs, two horizontal arms, and a bump.

The bump projects outward radially adjacent to the flat end of the left wheel and is disposed in abutment with the left end of the paint applicator sleeve to prevent the axial displacement towards left of the paint applicator.

Therefore, when in use, the paint applicator is axially restricted on both right and left sides being confined between the flange of the right wheel and the bump of the left wheel.

The insertion and the removal of the tubular paint applicator rely on inwardly flexible deformations of the horizontal arms of the clip.

The two vertical legs of the clip fasten the clip on the wheel and may secure the wheel on the shaft against axial displacement.

DETAILED DESCRIPTION

The object of the invention will appear more clearly from the following detailed description. It should be noted that the terms "horizontal", "vertical", "left", "right", in the text represent the directions when the paint roller lies with paint applicator axis and handle axis in horizontal planes, as depicted in drawing FIG. 1.

Figure 1:
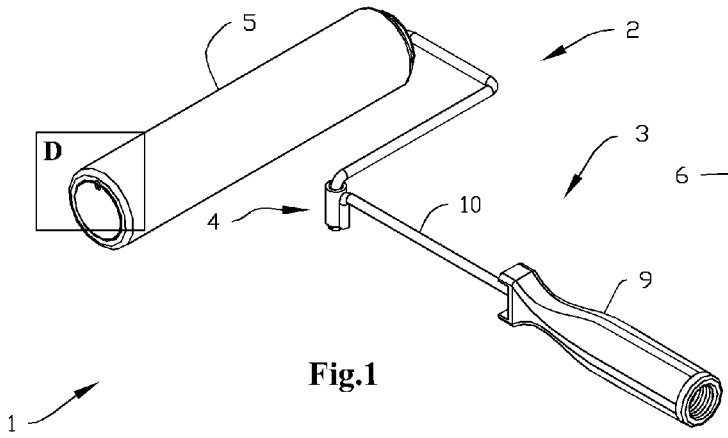
FIG. 1 is a 3 dimensional view of an embodiment of this invention
Figure 2:
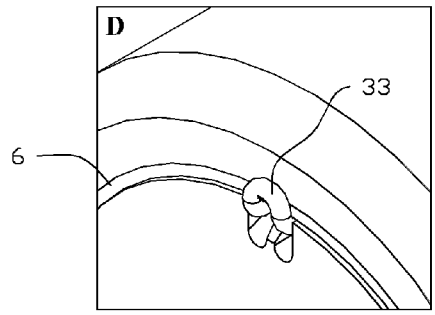
FIG. 2 is the enlarged detail D of FIG. 1, showing how the bump locks the paint applicator.
Figure 3:
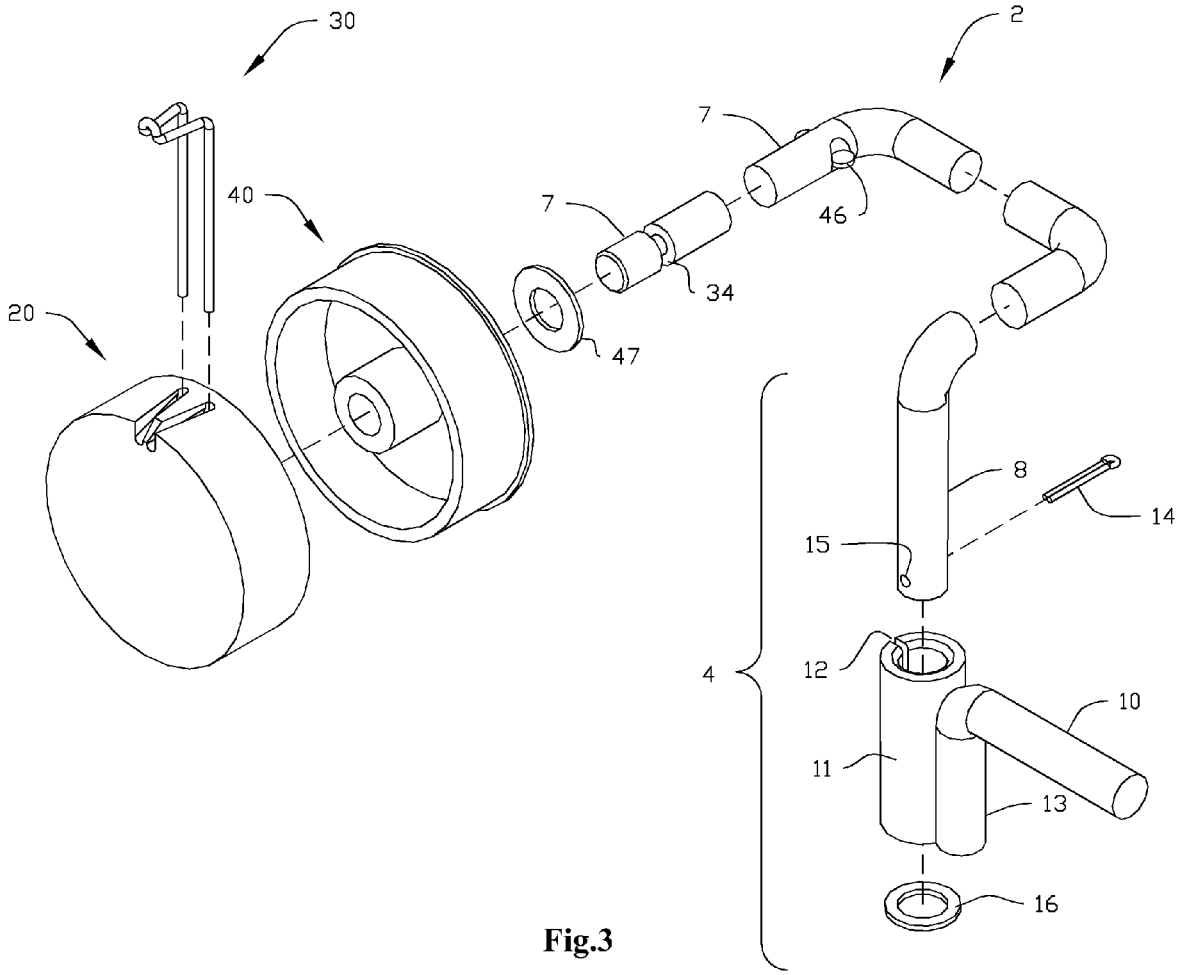
FIG. 3 is a partial exploded and enlarged view of the embodiment of FIG. 1.

Referring to the drawings FIG. 1 to 3 for now, a preferred embodiment of paint roller according with the present invention is shown.

The paint roller (1) includes a bent rod portion (2) and a handle portion (3) connected together by a friction hinge (4).

The paint roller uses a standard tubular paint applicator (5) having a sleeve (6).

The bent rod portion (2) has at one end an applicator shaft (7) and at the other end a hinge shaft (8).

The two ending shafts (7) and (8) of the bent rod are situated in two perpendicular planes.

The bent rod portion (2) of the roller paint is made out of wire stock curved to the desired shape.

The handle portion (3) includes a hand grip (9) and a handle rod (10) firmly joined together. The hand grip (9) can be for example a conventional plastic handle. The handle rod (10) makes the link between the hand grip (9) and the hinge housing (11) of the friction hinge (4).

Also, an embodiment without the handle rod (10) where the hinge is directly attached to the hand grip may be an alternative option.

The friction hinge (4) provides a swiveling connection between the handle and the paint applicator, and includes the hinge shaft (8) and the hinge housing (11).

The hinge housing (11) encloses coaxially the hinge shaft (8). They can rotate one related to the other.

On this preferred embodiment the hinge housing (11) has a bushing shape having a longitudinal split (12) to grant elasticity. On opposite side of the split, the bushing (11) is welded on a vertical portion (13) of the handle rod (10).

An interference between the outside diameter of the hinge shaft (8) and the inside diameter of bushing (11) is created by the fact that, before assembling, the outside diameter of the hinge shaft (8) is bigger than the inside diameter of bushing (11), therefore after assembling a contact pressure is generated.

The contact pressure develops a desired friction force that opposes a free uncontrolled rotation such as a torque is required for rotation.

In other words the friction hinge used here is a hinge purposely designed to set up a certain obstruction against a free swiveling movement between handle and the paint applicator.

A standard cotter pin (14) is inserted in a hole (15) of the hinge shaft (8) to stop the axial movement between the hinge shaft and the hinge housing. A washer (16) is interposed between the hinge housing and the cotter pin.

After inserting, the cotter pin legs are bent outwardly to secure it in place.

Figure 4:
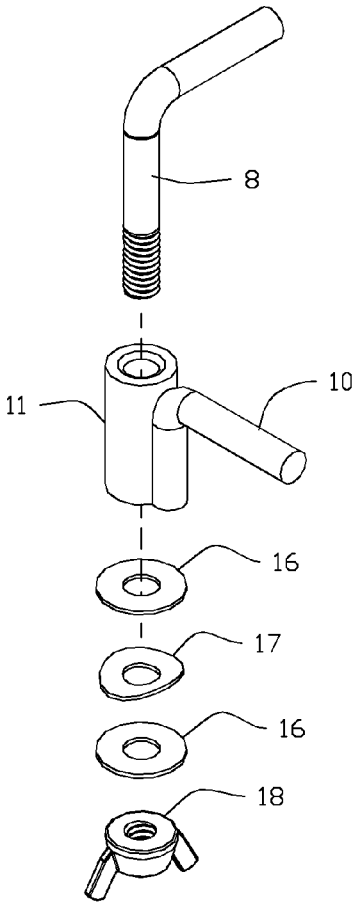
FIG. 4 is a second different embodiment of the Friction Hinge
Figure 5:
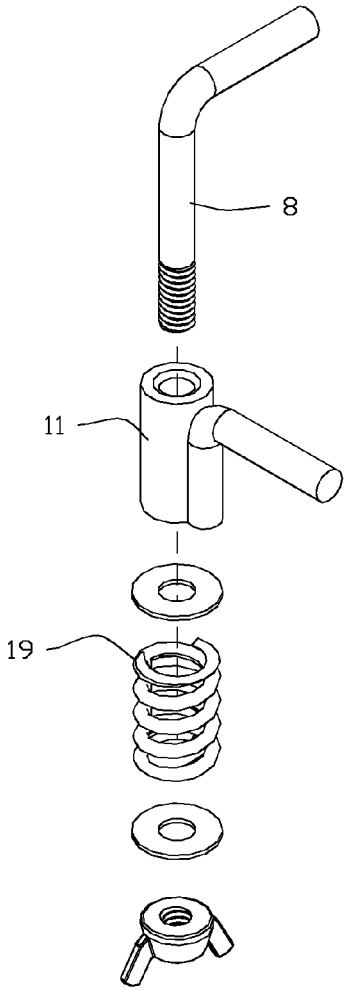
FIG. 5 is a third different embodiment of the Friction Hinge

Two different embodiments for the friction hinge will be mentioned related to FIG. 4 and FIG. 5; they are for illustrative purposes, and are by no means intended to limit application. For the similar structural and/or functional features, reference numbers have been assigned which correspond to the reference numbers of FIG. 1 to 3.

FIG. 4 depicts an alternative embodiment of the friction hinge described earlier; the hinge housing (11) is a bushing without the split, and the hinge shaft (8) has a thread at the end. The outside diameter of the hinge shaft (8) is slightly smaller than the inside diameter of bushing (11). A wave spring (17) is placed over the hinge shaft (8) and captured by two washers (16) between the hinge housing (11) and a butterfly nut (18).

The required torque between the hinge shaft (8) and the hinge housing (11) is generated by an axial interference through the contact pressure caused by the wave spring (17) being compressed. The torque can be adjusted by the butterfly nut.

Figure 16:
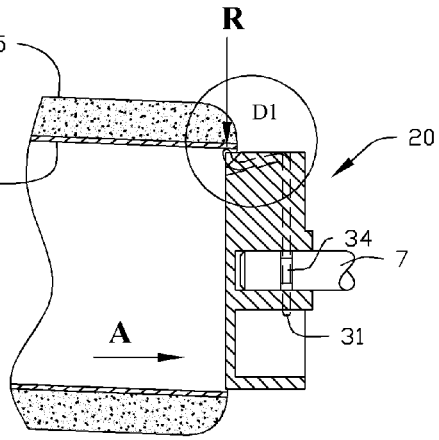
FIG. 16 is longitudinal section of the left wheel, showing how the paint applicator is installed.

FIG. 5 depicts also an axial type of friction hinge on which the wave spring (17) of FIG. 16 was replaced with a helicoidal spring (19).

A combination of radial and axial interferences may also be another option for building the friction hinge.

Figure 6:
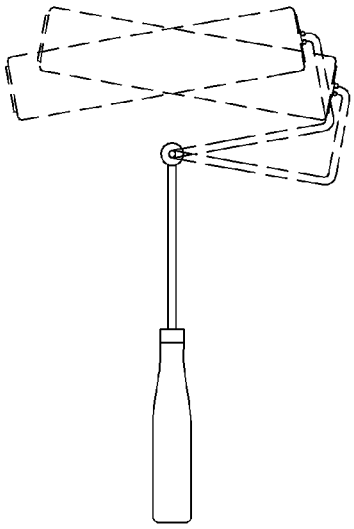
FIG. 6 is a top view of the paint roller showing how handle swivel during regular painting operation.

During the regular painting operation of the open walls and ceilings, the paint roller with a friction hinge as described above performs better than a regular rigid paint roller, because it allows a continuous slight swiveling movement of the paint applicator on left and right related to the handle, as it is shown in FIG. 6, such that the paint applicator has a permanent contact of its whole length under uniform pressure with the surface to be painted. Therefore, the user is released by the stress of finding the optimal painting position.

Figure 7:
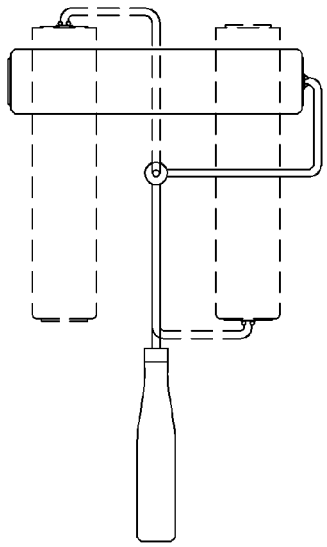
FIG. 7 is a top view of the paint roller showing how paint applicator swivel during extreme painting operation.
Figure 8:
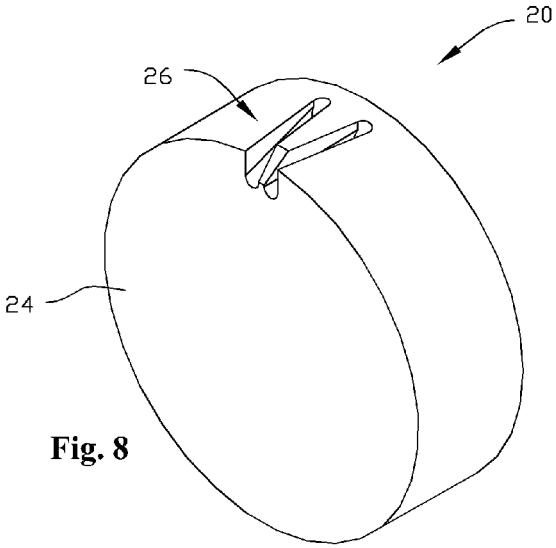
FIG. 8 is a 3D view of the left wheel
Figure 9:
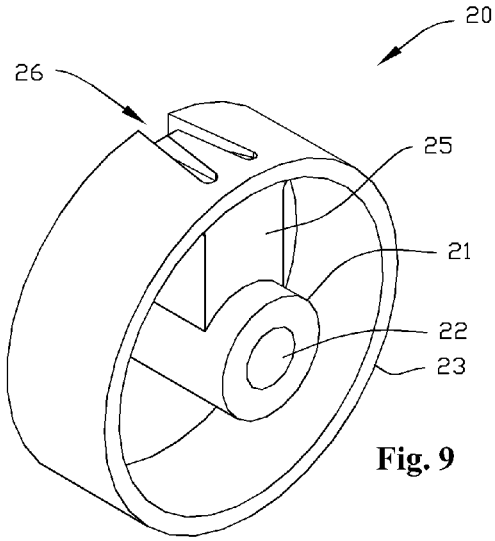
FIG. 9 is another 3D view of the left wheel
Figure 10:
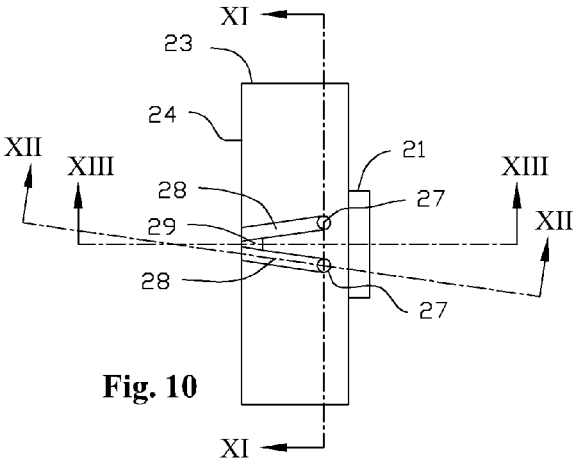
FIG. 10 is a top orthogonal view of the left wheel
Figure 11:
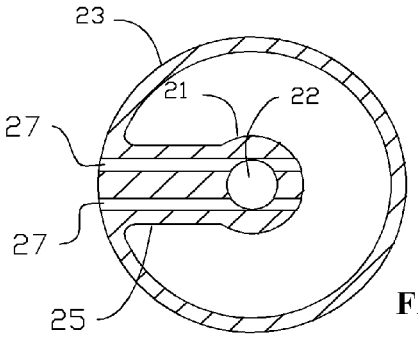
FIG. 11 is a cross sectional view along line XI-XI of FIG. 10

Furthermore, when painting operation occurs in narrow spaces such as closets or cabinets and in other circumstances where a rigid paint applicator is difficult or impossible to use, the friction hinge allows a bigger swiveling, up to 90 degrees, as shown in FIG. 7.

In both circumstances, no operator's intervention is required for adjusting the desired angle, but a reasonable push of the paint applicator against the surface to be painted.

As shown in FIG. 3, the applicator shaft (7) of the bent rod (2) rotatably sustains two supporting wheels, the left wheel (20) and the right wheel (40).

As shown in FIG. 8 to 13, the left wheel (20) that supports the left side of the paint applicator has a hub (21), a blind hole (22), an annular rim (23), a flat end portion (24), a spoke (25) and a clip housing (26).

The hub (21) contains the blind hole (22) for housing the left end of the applicator shaft (7).

The rim (23) that bears the inside surface of the sleeve (6) of the paint applicator, partially contains the clip housing (26).

The flat end portion (24) connects left side of the hub (21) with left side of the rim (23) and stops the paint to penetrate inside the paint applicator.

The radial spoke (25) provides a link between the hub (21) and the rim (23) and partially contains the clip housing (26).

The clip housing (26) has two parallel holes (27) and two oblique channels (28).

The two parallel holes (27) extend inwardly from the rim (23) through the spoke (25), through the hub (21) and intersect the shaft hole (22). (See especially FIG. 11)

Figure 12:
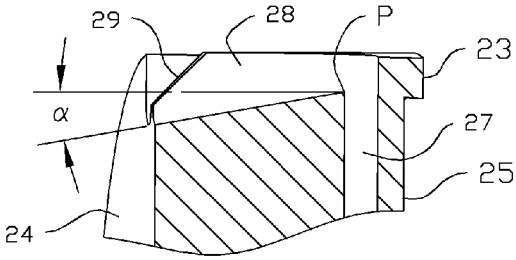
FIG. 12 is an enlarged detail of a cross sectional view along line XII-XII of FIG. 10
Figure 13:
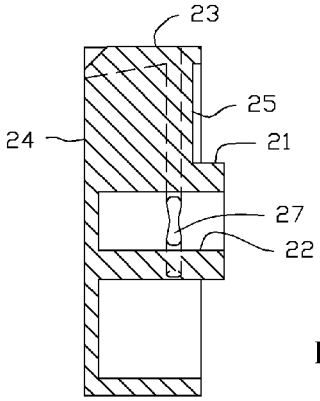
FIG. 13 is a cross sectional view along line XIII-XIII of FIG. 10

Two oblique channels (28) are made in the rim (23) in the area where the rim met the spoke (25), and make openings between the upper end of the holes (27) and the flat end portion (24), as shown in FIG. 12.

The bottom wall of the two channels (28) is tilted at an angle ($\alpha$) such that the points P where the channels (28) intersect the holes (27) is the highest point of the bottom wall. Also, a chamfer (29) is performed on the portion of the rim confined between the two oblique channels (28).

Figure 14:
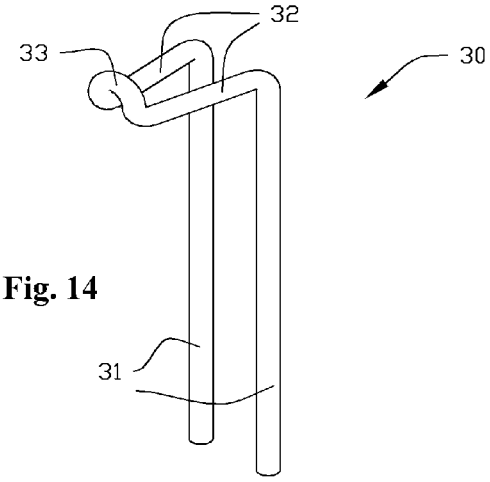
FIG. 14 is a 3D view of the clip

A clip (30) shown in FIG. 14 is contained into the clip housing (26) of the wheel (20). The clip (30) has two vertical legs (31), two horizontal arms (32) and a bump (33).

When the clip is inserted into the wheel (20), the two vertical legs (31) are contained into the two parallel holes (27), the two flexible horizontal arms (32) are contained into the two channels (28) and the bump (33) projects radially outward from the rim (23) next to the flat end portion (24) of the left wheel, as shown in FIG. 15 to 19.

Figure 17:
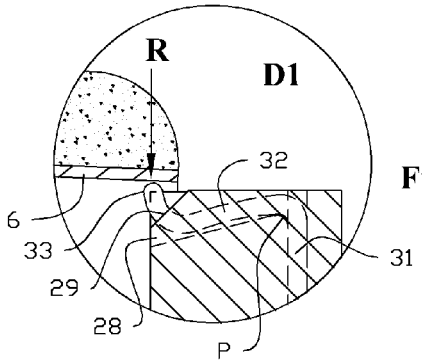
FIG. 17 is the enlarged detail D1 of FIG. 16, emphasizing how the paint applicator is installed.
Figure 19:
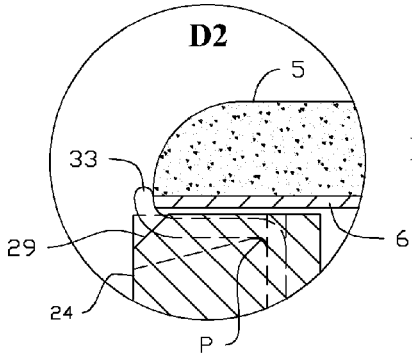
FIG. 19 is an enlarged detail D2 of FIG. 18, emphasizing how the paint applicator is locked on the left side.

The right sides of the horizontal arms (32) rest on the highest points (P) of the bottom wall of the oblique channels (28) as shown in FIGS. 17 and 19.

The two horizontal arms (32) which are the flexible support for the bump (33) can be bent inwardly with no wheel interference, due to the angle ($\alpha$) of the channels (28) and due to the chamfer (29), as shown in FIG. 17.

Figure 18:
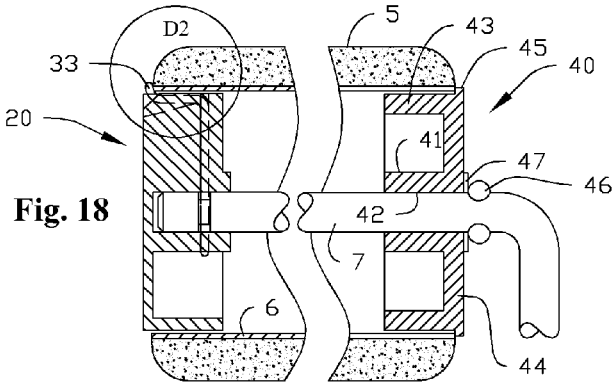
FIG. 18 is a longitudinal section along of the axis of applicator shaft showing the paint applicator installed.

The bump (33) is to prevent the axial displacement towards left of the paint applicator (5) as shown in FIGS. 18 and 19.

The two vertical legs (31) have double role, to fasten the clip (30) on the wheel (20), and also to secure the wheel (20) on the shaft (7) against axial displacement.

Figure 15:
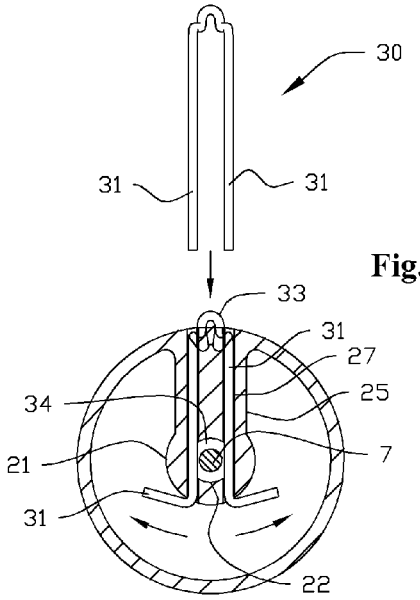
FIG. 15 is a cross sectional view of the left wheel with a plane containing the vertical legs of the clip, and also showing the way of clip installing.

The two parallel holes (27) which accommodate the legs (31), intersect the hole (22) which accommodates the shaft (7), while the shaft (7) has a grove (34) aligned and communicating with the holes (27), such that the legs (31) pass thru the grove (34) close to the grove diameter but not touching it, as shown in FIG. 15.

After inserting, the clip is secured in place by outwardly bending its legs (31).

The clip (30) is made from one piece of steel wire bent to the desired shape.

The right wheel (40), FIG. 18 that supports the right side of the paint applicator has, in generally, similar shape and dimensions with the left wheel.

It has a hub portion (41) containing a through shaft hole (42), an end flat wall portion (44) and an annular rim (43) that bears the inner of the right side of the sleeve (6).

An outwardly radial extension flange (45) engages the right end of the sleeve to prevent the paint applicator displacement towards right.

The right wheel (40) may be retained on the applicator shaft (7) against right axial movement in any suitable manner, for example, by staking the applicator shaft to provide two protrusions (46) adjacent to the wall portion (44) of the right wheel with a washer (47) interposed between the wheel and protrusions.

As shown in FIGS. 16 and 17, to insert the paint applicator (5), the sleeve (6) applies a radial pressure (R) directly to the bump (33) to bend the arm (32) into the channels (28), while concomitantly the paint applicator (5) is pushed over the wheel (20) in an axial direction (A) such that the wheel (20) will be contained into the sleeve (6) holding the bump (33) retracted.

The paint applicator is further pushed over the left wheel (20) and over the rim of the right wheel (40) until the whole length of the sleeve passes over the retracted bump (33), when the arm (32) will expand to regain its initial shape and concomitantly the axial movement of the paint applicator will be stopped by the flange (45) of the right wheel, as shown in FIG. 18.

Now the paint applicator is axially restricted on both left and right sides because it is confined between the bump (33) of the left wheel and the flange (45) of the right wheel.

In order to remove the paint applicator, an axially pulling force is required to apply on it, when a radial component of the pulling force will inwardly bend the flexible arms (32) of the clip, and the bump (33) will slide along the inner wall of the paint applicator sleeve.

The insertion and the removal of the tubular paint applicator may rely on both concurrent flexible deformations: inwardly of the flexible arms (32) and outwardly of the sleeve (6).

The diameter and the material of the clip wire should be suitable to be elastically bent when the paint applicator is manually pushed in or pulled out.

The above description depicts a roller paint where fastening of the paint applicator relies only on the wheels (20) and (40). However, using the clip of this invention on a typical wire or plastic cage roller frame construction may be an option.

The invention claimed is:

1. A paint roller for supporting a paint applicator, comprising:

a) a handle portion, b) a bent rod portion having an applicator shaft sustaining a right wheel and a left wheel for receiving the paint applicator the left wheel comprising: a hub, a hole, a rim, a flat end portion, a radial section, and a clip housing for receiving a clip, the clip housing having two parallel holes that extend inwardly from the rim through the radial section, through the hub, and intersect the shaft hole, and two channels made in the rim providing openings between the upper ends of the said holes and the flat end portion, the bottom wall of the two channels being tilted at an angle, the clip having two vertical legs contained into the two parallel holes, two flexible horizontal arms contained and bendable into the two channels, a bump that projects radially outward from the rim to restrict the paint applicator movement towards left, wherein the paint applicator is axially confined between a flange on the right wheel and the bump on the left wheel and wherein the insertion and the removal of the tubular paint applicator over the supporting wheels rely on flexible deformations of the horizontal arms of the clip.

2. A paint roller assembly of claim 1 wherein the insertion and the removal of the tubular paint applicator over the supporting wheels rely on both concomitant flexible deformations of the flexible arms of the clip inwardly and of the paint applicator sleeve outwardly.

3. A paint roller assembly of claim 1 wherein the two vertical legs of the clip secure the wheel on the shaft against axial displacement by passing thru a grove of the shaft aligned with the holes containing the legs.

4. A paint roller assembly of claim 1 wherein the clip is made out from one piece of steel wire bent to the desired shape.

5. A paint roller assembly using a tubular paint applicator, comprising:

a) a handle portion supporting a hinge housing, defining an inside diameter, b) a bent rod portion having an applicator shaft sustaining a right wheel and a left wheel for receiving the paint applicator, the left wheel comprising: a hub, a hole, a rim, a flat end portion, a radial section, and a clip housing for receiving a clip, the clip housing having two parallel holes that extend inwardly from the rim through the radial section, through the hub, and intersect the shaft hole, and two oblique channels made in the rim providing openings between the upper ends of the said holes and the flat end portion, the bottom wall of the two channels being tilted at an angle, the clip having two vertical legs contained into the two parallel holes, two flexible horizontal arms contained and bendable into the two oblique channels, a bump that projects radially outward from the rim to restrict the paint applicator movement toward left, c) a friction hinge, providing a swiveling connection between the handle portion and the bent rod portion, wherein the friction hinge is composed of the hinge housing coaxially containing the hinge shaft, and wherein between the hinge housing and the hinge shaft a contact pressure is provided which develops a desired friction force that opposes a free uncontrolled rotation, consequently a constant torque is required for rotation, and wherein the paint applicator is axially confined between a flange on the right wheel and the bump on the left wheel, the insertion and the removal of the tubular paint applicator over the supporting wheels relying on flexible deformations of the horizontal arms of the clip.

* * * * *